US006209851B1

(12) United States Patent
Eilertsen

(10) Patent No.: US 6,209,851 B1
(45) Date of Patent: Apr. 3, 2001

(54) DRILL FLOOR HOLE

(75) Inventor: Bjørn Eilertsen, Hundvåg (NO)

(73) Assignee: Engineering & Drilling Machinery AS, Stavanger (NO)

( * ) Notice: Subject to any disclaimer, the term of this patent is extended or adjusted under 35 U.S.C. 154(b) by 0 days.

(21) Appl. No.: 09/503,561

(22) Filed: Feb. 14, 2000

(30) Foreign Application Priority Data

Mar. 3, 1999 (NO) ..... 19991037

(51) Int. Cl.[7] ..... B66D 1/36

(52) U.S. Cl. ..... 254/338; 254/337; 166/77.51; 414/22.51

(58) Field of Search ..... 254/224, 242, 254/277, 334, 335, 336, 337, 338, 393, 394, 398, 399; 414/745.2, 22.51, 22.63, 22.68, 22.71; 166/77.51

(56) References Cited

U.S. PATENT DOCUMENTS 287,444 * 10/1883 Korner ..... 254/334
3,365,081 * 1/1968 Mclerran ..... 414/22.51
4,209,066 * 6/1980 Watson ..... 166/315
4,421,173 * 12/1983 Beakley et al. ..... 254/277
4,552,339 * 11/1985 Werners et al. ..... 254/335
4,647,014 * 3/1987 Ekman ..... 254/334
4,688,764 * 8/1987 Nayler et al. ..... 254/277
5,468,121 11/1995 Stogner .
5,762,279 * 6/1998 Horton, III ..... 254/337
5,833,016 * 10/1998 Carpenter ..... 175/85

FOREIGN PATENT DOCUMENTS

419539 * 1/1911 (FR) ..... 254/334

* cited by examiner

*Primary Examiner*—Donald P. Walsh
*Assistant Examiner*—Emmanuel M. Marcelo
(74) *Attorney, Agent, or Firm*—Cowan, Liebowitz & Latman, P.C.; Michael I. Wolfson

(57) ABSTRACT

A drill floor hole comprising a through-going vertical opening in a drill floor. A pipe holder is mounted so as to be capable of vertical movement below the opening. The pipe holder is suspended in a pulley loop in a wire drive wherein a wire is attached to the drill floor, runs down and over the pulley loop and passes up to a winch.

4 Claims, 1 Drawing Sheet

1
2
3
4
5
6
7
8
9
10
11
12
13
14
15

DRILL FLOOR HOLE

The invention relates to a drill floor hole, comprising a through-going vertical opening in a drill floor.

In a drill floor there is usually provided a so-called mousehole and/or rat hole which is used for holding joints of drill pipe, drill pipe stands and the kelly. The term drill floor hole as used herein is intended to include storage sites of this nature. On an offshore drilling platform, whether it is of the gravity type or a floater, there is usually a so-called cellar deck beneath the drill floor. A drill floor hole extends down through the drill floor and the cellar deck, to the extent required. On the cellar deck there will often be a need for space for moving/handling rather large pieces of equipment, e.g., safety relief valves, and it is therefore desirable to have as few obstacles as possible in the cellar deck area around the so-called moonpool.

U.S. Pat. No. 5,468,121 teaches a drill floor hole or mousehole wherein a wire drive is used to lift a pipe holder. However, what is typical of the embodiment in the U.S. patent is that a sleeve or an outer surrounding pipe, in which the pipe holder moves, is used for lifting the pipe joint that is positioned in the drill floor hole. This gives a design wherein the sleeve is in the way under the drill floor.

It is an object of the present invention to provide a drill floor hole which requires little space and, above all, which can, when not in use, be put in a position or state wherein it does not represent any obstacle to traffic under the drill floor.

According to the invention, a drill floor hole is therefore proposed, comprising an opening in a drill floor, a sleeve for the stabilising admission of a pipe joint through the opening, a pipe holder mounted so as to be capable of vertical movement relative to the sleeve, and a winch/wire/pulley assembly which includes a pulley loop on the pipe holder and a wire which runs down from a fixed point under the drill floor and then passes over the pulley loop and runs up to a winch, which pipe holder is freely disposed below the drill floor without a surrounding sleeve.

The pipe holder, which is designed for supporting interaction with the end of a pipe, a stand of pipe, a kelly etc., can, when not in use, be moved vertically upwards into a position immediately beneath and possibly partially recessed in the overlying drill floor.

It is especially advantageous if the wire can pass to the winch over a travelling block which is suspended immediately below the drill floor.

Advantageously, the winch may be located on a cellar deck beneath the drill floor.

Advantageously, the said travelling block may be suspended in the sleeve located in said opening in the drill floor.

Advantageously, the wire drive may include two parallel lines, i.e., two parallel wires and pulley loops, located on their respective sides of the pipe holder.

The invention will now be explained in more detail with reference to the drawings, wherein.

Figures 1, 2, 3:
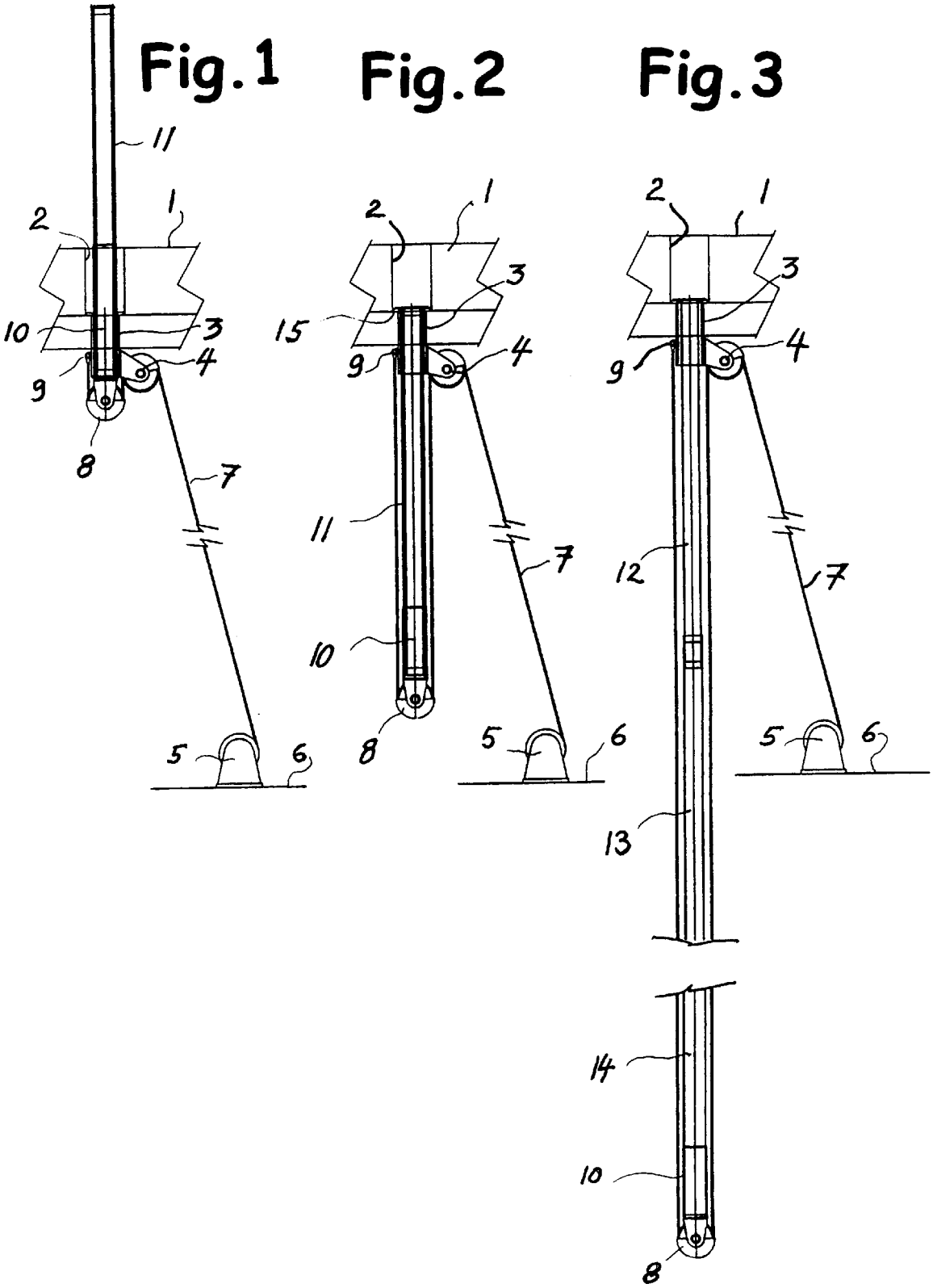
FIG. 1 shows a drill floor hole according to the invention, with a pipe holder moved up beneath a drill floor.
FIG. 2 shows the drill floor hole in a state wherein the pipe holder supports a pipe and is moved down into a position beneath the drill floor so that the pipe supported by the pipe holder does not project above the drill floor.
FIG. 3 shows a drill floor hole wherein there is positioned a stand of pipe string consisting of a number, for instance, four, pipes that are screwed together.

In a drill floor 1 a through-going vertical opening 2 has been cut out. In this through-going vertical opening 2 there is positioned a sleeve member 3 which rests on a ledge 15 in the opening 2 and extends some distance below the drill floor 1. The sleeve 3 is designed for tightly receiving a suitable pipe joint 11, the sleeve 3 thereby providing desirable stability for the pipe joint 11. The sleeve member 3 supports a travelling block 4. A wire 7 runs up from a winch 5 on a cellar deck 6 and passes over the travelling block 4 and then around a pulley 8 and from there passes up to a point of attachment 9 on the sleeve member 3.

A pipe holder 10 is mounted together with the pulley 8 and therefore is moved up and down with the pulley 8 as the wire 7 is reeled onto and off the winch 5.

The pipe holder 10 may be designed in many suitable ways. It may, for example, be in the form of a pin, which projects into a pipe end when a pipe or pipe joint is placed thereon, or it may be in the form of a cup sleeve, for receiving a pipe end. The pipe holder 10 may also, if so desired, be provided with attachment means (not shown) for attaching it to the pipe which is placed thereon. In this case, these means may be simple securing pins etc.

In FIG. 1 the pulley 8 and the pipe holder 10 are shown once they have been moved up to a position immediately below the drill floor 1. A pipe 11 has been placed on the pipe holder 10. In FIG. 1 the pipe 11 projects above the drill floor 1. In FIG. 2 the wire 7 has been reeled off winch so that the pulley 8 and the pipe holder 10 have been lowered so much that the pipe 11 is positioned with its upper end in the opening 2 in the drill floor 1.

In FIG. 3 it is shown how a stand of pipe string consisting of, for example, four pipes 12, 13, 14 that are screwed together, (only three pipes are shown because the figure is fragmentary), is supported in the drill floor hole. The wire 7 is then reeled off the winch 7 so much that the pulley 8 and the pipe holder 10 are lowered to a position in which the whole stand of pipe 12–14 is below the drill floor 1, with an upper part of the upper pipe 12 of the stand positioned in the sleeve member 3, which is in the vertical opening 2 in the drill floor 1.

When the drill floor hole is not in use, the pulleys 8 and the pipe support 10 may advantageously be moved up into the position shown in FIG. 1, thereby being out of the way for traffic on the cellar deck 6. The length of the drill floor hole and thus its ability to take up long pipes and stands of pipe, is determined initially by the wire drive, i.e., the length of the wire 7.

It is not shown in the drawings, but it may be advantageous to use two parallel pulleys 8 and two parallel wires 7 which run on the same winch 5. The two pulleys 8 are then placed preferably on their respective opposite sides of the pipe holder 10 and their respective sides of the supported pipe. This provides a more stable configuration of the drill floor hole. Of course, in an alternative embodiment of this kind two adjacently suspended travelling blocks 4 are used.

The movable pulley or travelling block 4 may, of course, be suspended directly in the drill floor 1, and the same applies to the attachment point/points 9 of the wire/wires. The winch 5 may also be positioned in a different location, e.g., on the drill floor, the wire 7 then being passed up through a separate opening in the drill floor to the winch positioned thereon.

What is claimed is:

1. A drill floor hole, comprising an opening in a drill floor, a sleeve designed for the stabilising admission of a pipe joint through the opening, a pipe holder which is mounted so as to be capable of vertical movement relative to the sleeve, and a winch/wire/pulley assembly which includes a pulley loop on the pipe holder and a wire which runs down from a fixed point under the drill floor and passes over the pulley loop and runs up to a winch, which pipe holder is freely disposed below the drill floor without a surrounding sleeve.

2. A drill floor hole according to claim 1, wherein the wire runs to the winch over a travelling block suspended under the drill floor.

3. A drill floor hole according to claim 1, wherein the winch is located on a cellar deck below the drill floor.

4. A drill floor hole according to claim 1, wherein the wire runs to the winch over a travelling block suspended in the sleeve member.

* * * * *